US005705812A

United States Patent [19]

Brewer et al.

[11] Patent Number: 5,705,812

[45] Date of Patent: Jan. 6, 1998

[54] COMPACTION MONITORING INSTRUMENT SYSTEM

[75] Inventors: James E. Brewer, Houston; Richard R. Pemper, Sugar Land; Izhar Ahmad, League City; Randy Gold, Houston, all of Tex.

[73] Assignee: Western Atlas International, Inc., Houston, Tex.

[21] Appl. No.: 656,503

[22] Filed: May 31, 1996

[51] Int. Cl.[6] ..... G01V 5/04; G01V 5/00

[52] U.S. Cl. ..... 250/264; 250/266; 73/784

[58] Field of Search ..... 250/259, 260, 250/261, 266; 73/784

[56] References Cited

U.S. PATENT DOCUMENTS

| | | | |
|---|---|---|---|
| 3,084,250 | 4/1963 | Dennis | 250/266 |
| 3,869,607 | 3/1975 | Sandier et al. | 250/260 |
| 4,396,838 | 8/1983 | Wolcott, Jr. | 250/260 |
| 5,005,422 | 4/1991 | Ruscev et al. | 73/784 |
| 5,272,336 | 12/1993 | Moake | 250/261 |

*Primary Examiner*—David P. Porta
*Assistant Examiner*—Richard Hanig
*Attorney, Agent, or Firm*—Alan J. Atkinson

[57] ABSTRACT

An apparatus and method for detecting the location of subsurface markers in a formation proximate to a borehole. The apparatus includes marker detectors in a housing having at least two housing sections attached in an initial orientation. The distance between the detectors is measured under controlled conditions with a calibration bar. The initial attached orientation between the housing sections is identified with a calibrator, and deviations from the initial attached orientation are identified by the calibrator after the housing sections are detached and reattached. The calibrator permits well site corrections to be made to the housing sections without recalibration. Gauges permit corrections for temperature and pressure fluctuations, and the corrected distances between the housing detectors is computed. Detectors in the housing generate signals when each detector is proximate to a marker in the formation, and such signals can be processed to identify the elevation of a marker in the borehole, or the distance between markers in the borehole, to determine formation compaction or settlement. In an apparatus having two detectors separated by a spacer, flexible retainers can be positioned between each detector and the spacer to permit thermal expansion or contraction of the detectors relative to the spacer.

30 Claims, 3 Drawing Sheets

Fig. 4
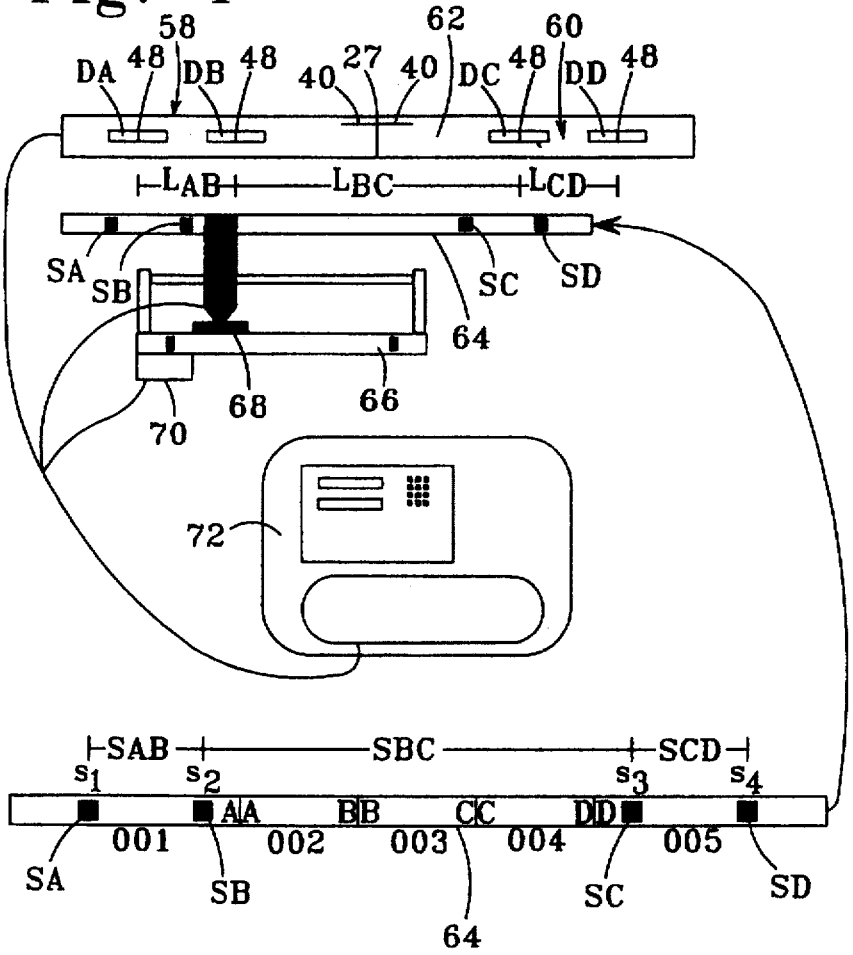
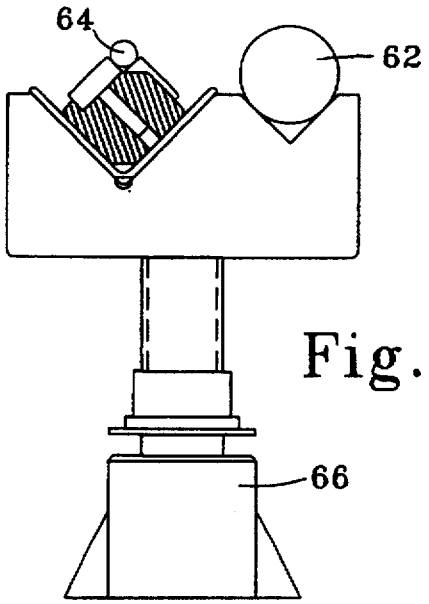
Fig. 5
Fig. 6
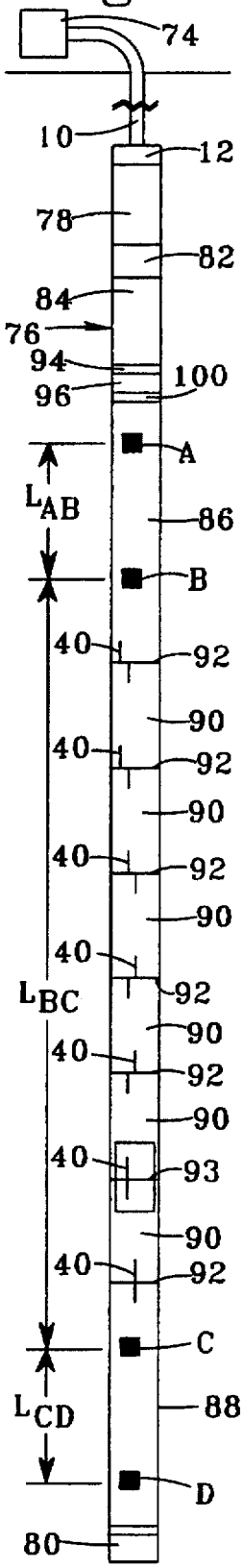

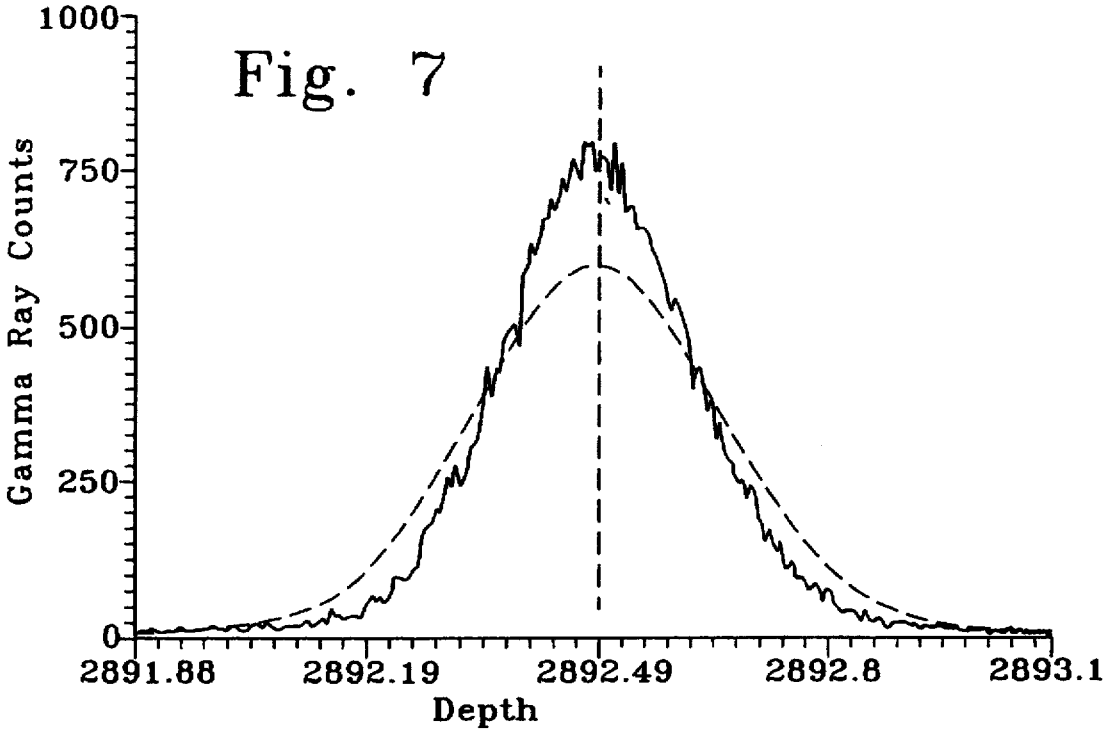
Fig. 8
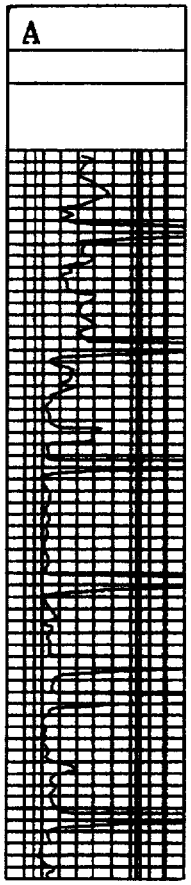
Fig. 9
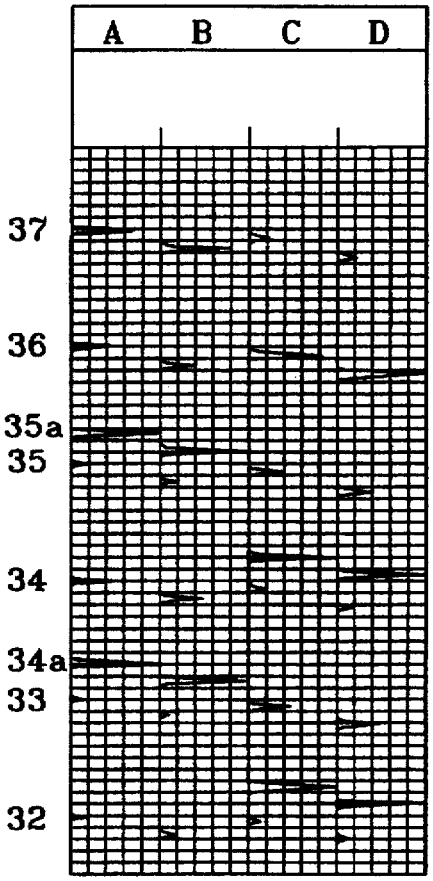

COMPACTION MONITORING INSTRUMENT SYSTEM

BACKGROUND OF THE INVENTION

The present invention relates to the field of compaction measurements in geologic formations. More particularly, the invention relates to an improved apparatus and method for accurate measurement of subsurface formation compaction after fluids have been withdrawn from the formation.

The production of water and hydrocarbon fluids depletes subsurface reservoir pressure and removes the fluids from the interstitial pore space in the reservoir rock. As subsurface hydrocarbon fluids are removed, the reservoir rock compacts due to the overburden weight. This compaction and the corresponding settlement is heightened where the reservoir rock comprises chalk or other rock having relatively high porosity and low compressive strength.

Excessive reservoir compaction and settlement can fracture borehole casing, can threaten the stability of surface structures, and can increase flooding risks in coastal areas. Excessive reservoir compaction can permanently damage the permeability and hydrocarbon producing capability of a reservoir if the interstitial pore space is irreparably closed.

Various techniques have been developed to detect and evaluate reservoir rock compaction during the withdrawal of fluids such as hydrocarbons. Well casing shortening can also indicate relative compression of the adjacent formation. One compaction detection technique positions radioactive pellets at selected intervals in the reservoir rock adjacent a borehole or on the casing. The pellets comprise a weak radioactive source such as 100 microcurie Cesium 137 encased in a stainless steel shell. A logging tool is moved relative to the radioactive pellets so that data related to the location of the pellets is detected and recorded. One example of this technique was disclosed in U.S. Pat. No. 3,869,607 to Sandier et al. (1975), showing three detectors incorporated into a logging tool. Upper and lower detectors were spaced at distances approximate to the marker spacing so that adjacent markers could be detected with minimal tool movement. A description of processing procedures for a three detector system was described in Green, *Subsidence Monitoring in the Gulf Coast*, Society of Petroleum Engineers Inc. (1991).

Another compaction detection technique was disclosed in U.S. Pat. No. 4,396,838 to Wolcott, Jr. (1983), showing a gamma detector positioned downhole in a sonde. The gamma detector was reciprocated with a reversible motor to scan the formation and to detect incremental movement of a gamma source.

Known compaction detection techniques experience systematic errors, random errors, and other errors. Although cable movement can be accurately controlled at the borehole surface, friction between the interior casing wall and a logging tool creates "stick-slip" conditions which contribute to erratic tool movement. Tool "bounce" occurs due to the elasticity of the cable as the cable stretches and recompresses. Irregular tool movement such as stick-slip type movement and tool bounce are not accurately detected by depth wheel indicators. An accelerometer can correct certain erratic tool movement, however changes in cable length due to tension variations are not easily detected. As discussed in Mobach et al., *In-Situ Reservoir Compaction Monitoring in the Groningen Field* (1994), error factors are increased in horizontal and deviated wells and in wells having a rough casing interior.

Because relatively small subsidence intervals can have significant consequences in a hydrocarbon producing reservoir, the measurement errors in conventional compaction detection systems are unacceptably large. Various efforts have been proposed to reduce measurement error. Tools have been constructed with Invar to reduce tool expansion at elevated downhole temperatures. One measurement approach incorporated a downhole odometer as disclosed in Allen, *Developments in Presicions Casing Joint and Radioactive Bullet Measurements for Compaction Monitoring*, Society of Petroleum Engineers (1981), where odometer wheels were spring loaded against the interior casing wall. Another concept anchored the logging tool to the casing during logging measurements as shown in U.S. Pat. No. 5,005,422 to Ruscev et al. (1991). Although a stationary tool can reduce certain dynamic errors, the logging measurements require excessive rig time. Additionally, the stationary positioning of the tool increases the possibility of cable sticking and acceleration errors during tool movement.

For many years, state of the art compaction detection systems required extensive well site tool calibration of scintillation detectors before logging runs were conducted. Well site calibration identifies the distances between effective response centers in the detectors. Well site calibrations require time, are expensive, and introduce new errors into the tool calibration process. To perform a well site calibration, long calibration bars are constructed in detachable sections to facilitate transportion of the calibration system to the well site. Once the calibration system reaches the well site and is reattached, calibration tests typically require one-half to one and one-half days to complete. Such calibration tests also require up to fifty feet of space for the tool and the calibration system. This large calibration space requirement disrupts well operations and is difficult to perform on offshore platforms having limited deck space.

Well site calibrations are typically performed at local ambient conditions which introduce potential errors into the calibration tests. Over the duration of the calibration tests, changes in the ambient temperature require correction for thermal expansion and contraction. Conventional well site calibration test equipment also includes cables and other moving parts which introduce additional variables and potential errors into the calibration tests. To compensate for such variables, numerous calibration tests are performed with multiple sources, and the resulting data is processed to average the response center distances between tool detectors. Well site tests interrupt valuable rig time and do not effectively account for systematic errors in the calibration test equipment. Such systematic errors may vary from one well test system to another, adversely affecting the repeatability of data generated for a well.

In subsurface compaction measurements, settlement of one millimeter can have significance in evaluating reservoir performance and the impact of a reservoir maintenance program. Accordingly, the need to minimize data collection and processing errors is essential. Because the one millimeter interval subject is typically located thousands of meters below the surface, any errors in a surface managed data gathering and processing system can easily exceed the one millimeter interval subject. Errors can be caused by the length and movement of the logging cable, differential thermal expansion of the components in the logging tools, and other factors. In a high temperature borehole, elevated temperatures cause significant differential movements within a logging tool. The coefficient of thermal expansion for conventional Sodium Iodide scintillation crystals is approximately twenty-five times that of a low expansion material such as Invar, and the coefficient of thermal expansion for stainless steel is approximately ten times that of Invar. Additionally, data gathering and processing errors can occur due to nonuniform marker detected responses caused by changes in the orientation and displacement between markers and logging detectors in a borehole.

Another limitation of conventional compaction detection systems is the difficulty of providing an accurate historical record of formation compaction over the life of a producing well. Conventional calibration test systems are subject to individual systematic errors. The optical properties of scintillation crystals change over time due to thermal cycling and other factors. Radioactive decay in the downhole markers affects the signal received by detectors, and other variables affect the repeatable performance of conventional compaction measurement systems. The ability to generate accurate, verifiable data is essential to long term formation compaction monitoring programs, and to the evaluation of well control programs designed to reduce formation compaction.

Accordingly, a need exists for an improved apparatus and method that faciliates calibration of formation compaction equipment and that provides accurate measurements of formation compaction.

SUMMARY OF THE INVENTION

The present invention provides an improved apparatus for insertion into a borehole to detect the location of a subsurface marker. The apparatus includes first and second housing sections, first and second detectors each attached to a housing section for generating a signal responsive to the marker, and a calibrator engaged with the first and second housing sections for identifying an initial attached orientation and for identifying deviations from said initial attached orientation following detachment and reattachment of said first and second housing sections.

In other embodiments of the invention, the housing sections can be attached rotatably, longitudinally, or with a connector. Temperature and pressure gauges can be attached to the first housing for generating signals identifying the borehole temperature and pressure. A controller can receive the signals generated by the first and second detectors and by the temperature and pressure gauges. The controller can calculate the distance between the subsurface marker and the surface or can accurately calculate distances between adjacent subsurface markers regardless of the borehole temperature or pressure.

A third detector and a fourth detector can be attached to the first and second housing sections to generate additional signals responsive to a subsurface marker. To automatically compensate for temperature variations in the borehole, a spacer can be positioned between first and second detectors, and first and second flexible retainers can be engaged with the first and second detectors to permit thermal expansion of the first and second detectors toward the spacer.

The method of the invention is practiced by placing a first housing section, engaged with a marker sensing first detector, proximate to an attachable second housing section engaged with a marker sensing second detector, by attaching the first housing section to the second housing section, and by identifying the deviation of a calibrator engaged with the first and second housing sections from an initial attached orientation. In other embodiments of the invention, various detectors can be moved proximate to one or more subsurface markers, signals representing such markers can be transmitted to a controller, the signals can be correlated to a selected distribution curve to identify each signal segment representative of a marker, and the peak of each distribution curve can be identified. The controller can also receive temperature and pressure signals to calculate temperature and pressure corrections for each distance between adjacent subsurface markers.

BRIEF DESCRIPTION OF THE DRAWINGS

FIG. 4 illustrates a four detector apparatus proximate to a calibration bar.

FIG. 5 illustrates an end view of the calibration bar and housing supported with a stand.

FIG. 6 illustrates a logging tool incorporating the invention.

FIG. 7 illustrates a correlation between a selected distribution curve and data representative of a marker.

FIG. 8 illustrates data from one detector.

FIG. 9 illustrates comparative data from four detectors.

DESCRIPTION OF THE PREFERRED EMBODIMENTS

The present invention provides an improved apparatus and method for detecting and evaluating compaction of a subsurface formation. The invention is particularly useful in providing an apparatus that can be calibrated in a controlled environment, and that can be transported to the field, reassembled, and operated without recalibration.

Figure 1:
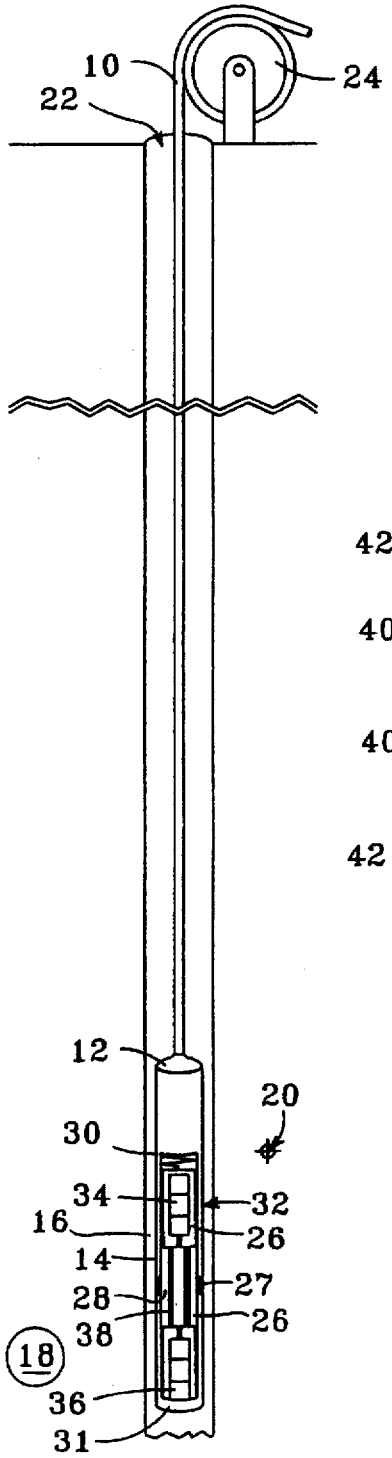
FIG. 1 illustrates components of a logging apparatus in a borehole.

Referring to FIG. 1, an elongated member such as wireline or cable 10 has a lower end identified as cablehead 12 attached to housing 14. Cable 10 and housing 14 are inserted or lowered into borehole 16 drilled through subsurface geologic formations 18. Markers 20 are positioned within geologic formations 18 at selected positions proximate to borehole 16. At the surface 22 of borehole 16, depth wheel 24 selectively permits the deployment of cable 10 while measuring the length of cable 10 deployed into borehole 16.

As used herein, the term "marker" comprises any subsurface anomaly capable of detection. Marker 20 includes radioactive pellets, variations in reservoir porosity or permeability or composition, variations in the thickness of casing or tubing (such as casing joints), and other detectable anomalies within the subsurface formation or within artificial tools or structures positioned within formations 18.

Housing 14 includes at least two housing sections 26 detachably engaged with a threaded connection or other connector 27. Housing 14 is preferably constructed from a material capable of withstanding borehole 16 conditions exceeding 350 degrees F. and 15,000 psi. Housing 14 includes hollow elongated interior 28 having first end 30 and second end 31. Detector assembly 32 is positioned within housing interior 28 and includes first detector 34 for generating a signal when first detector 34 is proximate to one of markers 20. Detector assembly 32 also includes second detector 36 for generating a signal when second detector 36 is proximate to one of markers 20. Spacer 38 is placed between first detector 34 and second detector 36 and is preferably constructed with a material having a low coefficient of thermal expansion such as Invar.

Figure 2:
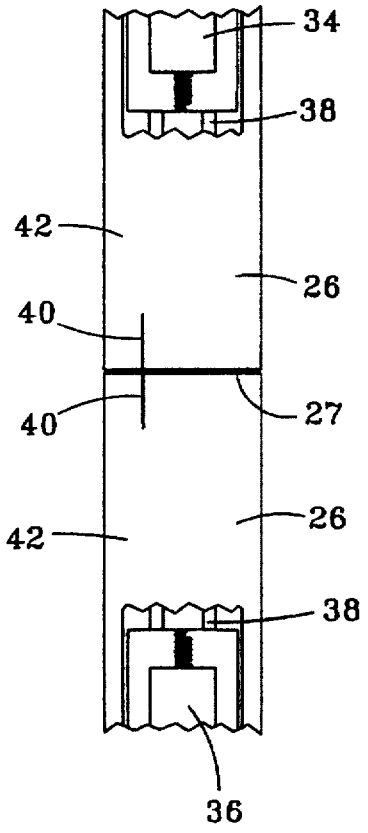
FIG. 2 illustrates one embodiment of a calibrator for the apparatus housing.

Referring to FIG. 2, detail of the connector 27 between housing sections 26 is shown. Each housing section 26 has a calibrator such as calibration mark 40 cut, etched, stamped, or otherwise formed into outer surface 42 of each housing section 26. Calibrator or calibration marks 40 define an initial attached orientation between housing sections 26. Preferably, calibration marks 40 are established when housing 14 is initially calibrated under known, controlled temperature and pressure conditions. If the desired measurement of subsurface compaction is one millimeter or less, the tool calibration is preferably accurate within 0.5 millimeter or less. Subsequently, housing sections 26 can be detached and reatttached so that calibration marks 40 are aligned in the initial attached orientation. Alternatively, any deviation between calibration marks 40 from the initial attached orientation can be identified after housing sections 26 have been detached and reattached.

Although two housing sections 26 and calibration marks 40 are illustrated in FIG. 2, additional housing sections 26 and corresponding calibration marks 40 can be combined to form a housing 14 of a desired length, or to permit the detachment of housing 14 into sufficiently short housing sections 26 to facilitate transportation and storage. The sum of plus and minus deviations from the initial attached orientation for adjacent housing sections 26 can be added to calculate overall shrinkage or expansion between first detector 34 and second detector 36.

The calibrator identified as calibration marks 40 provides a mechanism for calculating deviation from the initial attached orientation. As shown, calibration marks 40 are oriented parallel with the longitudinal axis of housing 14. If connector 27 between housing sections 26 is a threaded connection comprising a known threadform, and if the reattachment of housing sections 26 results in an orientation wherein calibration marks 40 on adjacent housing sections 26 are not aligned in the initial attached orientation, the resulting increase or decrease in the length of housing 14 can be determined. For cylindrical outer surfaces 42, such length difference can be calculated from the angular difference between corresponding calibration marks, the diameter or circumference of outer surfaces 42, and the thread pitch of connector 27. One correction technique uses the relationship $\Delta_{BC}=P \sin^{-1} (x_i/\text{Diameter})/\pi$ to determine the longitudinal change in length.

Calibration marks 40 permit the detachment, reattachment and operation of housing 14 and associated components without requiring subsequent recalibration of housing 14 and the associated components. Housing 14 and the associated components are initially calibrated under known conditions for temperature, pressure, and marker orientation, and the need for subsequent recalibration at a well site is eliminated. Calibration marks 40 are particularly useful when different torques are applied to attach housing sections 26, and when the threads of connector 27 experience wear due to repeated attachment and detachment cycles.

Although calibration marks 40 are illustrated for a rotatable threaded connector 27 having mated threads, other forms of connector 27 and calibration marks 40 are contemplated by the invention. If housing sections 26 are attached with a stab type connection or with another configuration of axial connection, calibrations 40 could be perpendicular to the longitudinal axis through housing sections 26 or could encompass other forms. In various embodiments of connector 27, a calibrator such as calibration marks 40 define the initial attached orientation so that deviations in the subsequent makeup of housing sections 27 can be be adjusted without requiring recalibration of the entire tool.

Figure 3:
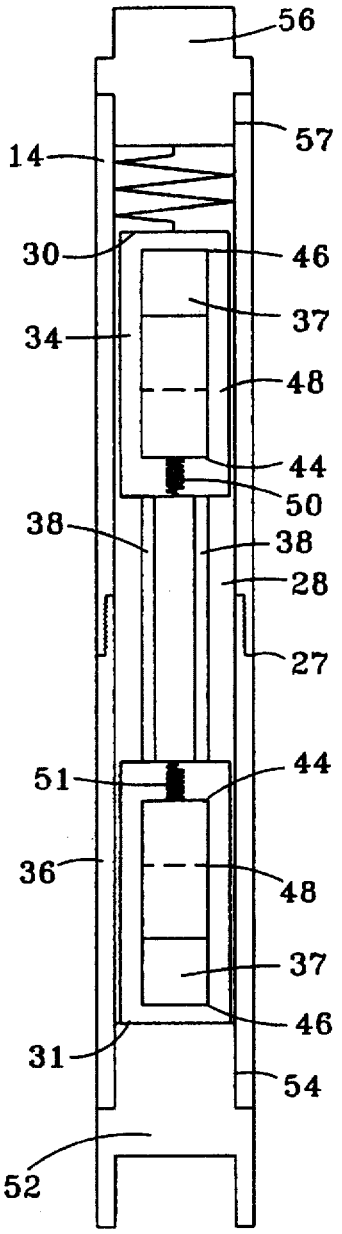
FIG. 3 illustrates a temperature compensation configuration within the apparatus housing.

FIG. 3 illustrates one embodiment of housing 14 wherein first detector 34 and second detector 36 are positioned within housing interior 28. In one embodiment of the invention as shown in FIG. 3, first detector 34 and second detector 36 comprise Sodium Iodide (NaI) scintillation crystals coupled to photomultiplier tubes 37 as known in the art. Such crystals, having a thermal expansion coefficient of $25.8\times 10^{-6}$ degrees F., thermally expand at a rate approximately twenty-five times that of Invar, which has a thermal expansion coefficient of $0.9\times10^{-6}$ degrees F. First detector 34 and second detector 36 each have a first end 44 and a second end 46, and have an effective response center generally identified as 48. Although the effective response center 48 will be proximate to the middle of each Sodium Iodide crystals, such crystals can be nonuniform over the crystal length. Consequently, variations and anomalies in the crystals may create an effective response center 48 at a position different than the physical center of the Sodium Iodide crystals.

As shown in FIG. 3, first ends 44 of first detector 34 and second detector 36 are engaged with spacer 38. A first flexible retainer such as spring 50 is positioned between first detector first end 44 and spacer 38 for permitting thermal expansion of first detector 34 toward spacer 38. A second flexible retainer such as spring 51 is positioned between first end 44 of second detector 36 and spacer 38 to permit thermal expansion of second detector 36 toward spacer 38. In this configuration, spacer 38 and detectors 34 and 36 can be oriented to automatically correct for thermal expansion and contraction within housing 14. As the borehole temperature increases, the length of spacer 38 increases to lengthen the actual distance between the respective response centers 48 of first detector 34 and of second detector 36. However, this axial outward movement is offset and is balanced by the axial inward expansion of first detector 34 and second detector 36, which respectively move response centers 48 inwardly toward spacer 38. Relative movement therebetween is accomodated by springs 50 and 51, which can be placed in different positions and can be configured in different forms. By calculating the coefficient of thermal expansion for each component and the correlative length of each component, the overall distance between adjacent response centers 48 can be stabilized regardless of temperature fluctuations within housing 14.

Second end 46 of second detector 36 contacts interior second end 31, illustrated in FIG. 3 as one end of a lower sub 52 engaged by threaded connection 54 to housing 14. Upper sub 56 engages interior first end 30 with threaded connection 57 and provides a stop for retaining first detector 34. Calibration marks 40 can be provided between lower sub 52 and housing 14 and between housing 14 and upper sub 56 as previously discussed.

FIG. 4 illustrates an embodiment of the invention wherein first detector assembly 58 and second detector assembly 60 are positioned within housing 62. First detector $D_A$ and second detector $D_B$ are positioned within first detector assembly 58, and third detector $D_C$ and fourth detector $D_D$ are positioned within second detector assembly 60. Each detector "D" has a response center 48, and the lengths between response centers 48 for each detector $D_{A-D}$ is illustrated as "L". For example, the length between response centers 48 for first detector $D_A$ and second detector $D_B$ is identified as $L_{AB}$.

FIG. 4 illustrates one calibration apparatus and procedure. All calibration activity is preferably performed at a selected pressure and temperature, such as one atmosphere and 68 degrees F. (20 degrees C.). Calibration bar 64 determines the distances between detectors $D_{A-D}$ in housing 62. Calibration bar 64 can be certified according to selected standards to provide redundancy and repeatability over time. The accuracy of the distances between imbedded sources $S_{A-D}$ in calibration bar 64 can be certified to an accuracy less than 0.01 mm. Calibration bar 64 is positioned parallel to housing 62 and the displacement between calibration bar 64 and housing 62 is stabilized with stand 66 as shown in FIG. 5. Calibration bar 64 preferably comprises a material resistant to thermal expansion such as Invar. Sources $S_{A-D}$ comprise radioactive sources such as 100 microcurie Cesium 137 and are positioned at selected positions along bar 64. For example, the spacing between sources $S_A$ and $S_B$ is precisely measured and is identified as $S_{AB}$.

In a preferred embodiment of the invention, the relative spacings between the centers of sources $S_{A-D}$ are substantially identical to the relative spacings between detectors $D_{A-D}$. Because the response centers 48 of such detectors are not initially known, sources $S_{A-D}$ are spaced in a fashion so that such sources are substantially spaced equal to the estimated response centers of the detectors. By coordinating the spacings of sources $S_{A-D}$ and detectors $D_{A-D}$, measurement errors are substantially reduced, and the accuracy of calibrating the detector spacings on housing 62 is substantially increased.

Housing 62 and the associated detectors are calibrated by moving housing 62 relative to calibration bar 64. In a preferred embodiment of the invention, housing 62 is anchored in a stationary position relative to stand 66. Calibrator bar 64 is moveably retained by trolley 68 having motor 70 connected to control panel 72. Trolley 68 can include a motorized linear actuator for selectively moving calibration bar 64, and can further include a linear position encoder for indicating the position of calibration bar 64 as a function of time. If desired, calibrator rod 64 can be constructed in detachable and reattachable bar sections having calibration marks for accurately permitting disassembly and assembly of calibration bar 64.

As shown in FIG. 4, calibration bar 64 is initially retained in a position relative to housing 62 where sources $S_{A-D}$ are not proximate to detectors $D_{A-D}$. Trolley 68 moves calibration bar 64 in a linear direction parallel to the longitudinal axis of housing 62 so that sources $S_{A-D}$ pass detectors $D_{A-D}$. Calibration data is collected at one second intervals with calibration bar 64 moving sources $S_{A-D}$ across detectors $D_{A-D}$ at a speed of one foot per minute. This combination corresponds to a distance interval approximating 5.08 mm for each data point in the gamma ray distributions used in determining the response centers 48 for each detector D. As each source passes one of detectors D, each detector D generates a signal representing a distribution of gamma counts. Such signal is transmitted to controller 74 for processsing. From these signals the spacings between response centers 48 for each detector D can be calculated. Based on field measurements, the standard deviation of the spacings for detectors D is approximately 0.25 mm.

Although calibration bar 64 is moved over an interval of several feet, the distance measured to calibrate the detector spacings is typically less than 0.1 inches, which is the typical distance between the source spacing and the true detector spacing. By reducing the movement required, errors are significantly reduced and the resulting calibration results are accurately rendered.

After housing 62 has been calibrated against calibration bar 64 to identify spacings between sources $S_{A-D}$, the relative position of calibration marks 40 are recorded, and housing 62 can be disassembled into housing sections 26 for storage or transport. Housing sections 26 can transported to the surface of borehole 16 and can be reassembled into housing 62. If calibration marks 40 are not aligned in the same orientation observed during the original calibration, the deviations from the initial attached orientation are recorded as previously discussed. From these measurements, the corresponding increase or decrease in the spacings between detectors $D_{A-D}$ can be calculated manually or with controller 74. For a threaded connector 27 between detectors $D_{B-C}$, angular displacement in calibration marks 40 at threaded connector 27 from the original calibration can provide sufficient data to calculate the length correction for $L_{BC}$. Calibration marks 40 permit this correction independent of differences in temperature between the original calibration and the surface at the well site of borehole 16.

Referring to FIG. 6, another embodiment of the invention is illustrated wherein cable 10 and cablehead 12 are attached to housing 76. Housing 76 includes swivel 78 at the housing 76 upper end and bull plug 80 at the housing 76 lower end. Telemetry power supply 82 provides power to telemetry instrumentation 84. Housing 76 includes first detector assembly 86 and second detector assembly 88 each having two gamma detectors. Detector assemblies 86 and 88 are separated with housing sections 90 attached with connectors 92 having calibrators such as calibration marks 40 as previously described. Another embodiment of a calibrator is identified as connector 93 which forms an independent tool connection for attaching and calibrating adjacent housing sections 90. Housing sections 90 can function as spacer bars and can incorporate different components such as borehole temperature gauge 94, borehole pressure gauge 96, accelerometer 98, and one or more casing collar detectors 100. Accelerometer 98 detects fluctuations in tool velocity (acceleration) measured real-time in x, y and z directions so that adverse operating conditions can be adjusted for post log corrections. Data from temperature gauge 94 and pressure gauge 96 can be transmitted to controller 74 as discussed below. Data from accelerometer 98 can be transmitted to controller 74 to monitor real time movement of housing 76.

To operate the system, housing 76 is lowered into borehole 16 with cable 10 to the target interval within borehole 16. Depth wheel 24 indicates the approximate placement of housing 76, and can be operated to incrementally raise or lower housing 76 at a selected rate. For example, the rate of ascent can approximate 1.5 meters per minute. Housing 76 can be centralized or decentralized within borehole 16.

As housing 76 is raised and each of detectors A–D passes markers 20, count rates for each detector A–D are measured at a sample rate of 160 records per meter. When a detector approaches a marker 20, the count rate will increase until a maximum value indicates that the detector response center 48 is directly proximate to the marker 20. As the detector passes the marker 20, the count rate will decrease to a background level. A signal is generated by each detector corresponding to each marker 20 and is transmitted to controller 74 for processing. FIG. 7 illustrates one representative signal showing a distribution plot. For scintillation detectors, each signal is processed to generate curves representative of the distribution of the gamma data. The signals are processed by comparing the signals to an ideal or selected distribution curve (such as a Gaussian distribution curve or an analytically developed curve) to identify segments of each signal having a profile or shape similar to the ideal or selected distribution curve. By performing this unique step, background noise is significantly reduced, the remaining signals represent detector signals responsive to markers 20, and the signal segments can be enhanced or magnified for peak identification and for further processing operations. The center of the curve, illustrated as a dotted line in FIG. 7, is identified to indicate the calculated position of marker 20.

When the data is acquired by detectors A–D and is processed to identify the center of each signal, such data is corrected to account for differences in the makeup of housing 76 (from the calibration mark data), and to account for differences in the borehole temperature and pressure from the calibration standards. A single correction factor accounting for temperature, pressure, and depth wheel corrections can be added or subtracted to the peak value calculated by the functions described above. Temperature variations for calibrator bar 72 are determined by the relationship $\Delta S_{AB}$ (Temp)$=\alpha_{Invar}$ [$S_{AB}$(Nist)] ($T_{ext}-T_{NIST}$), where NIST represents the National Institute of Standards and Technology. The relationship for corrected calibrator bar source spacings is therefore $S_{AB}$ (corrected)$=S_{AB}$(NIST)+66 $S_{AB}$(Temp). Housing 76 can be lowered and subsequent logs can be run for the same interval.

FIGS. 8 and 9 illustrate a representative log pass. FIG. 8 represents a log chart for detector A, and FIG. 9 represents comparative data indicating signals generated by detectors A–D in response to subsurface markers 20.

As previously noted, the depths measured by a well logging system are inferred by depth wheel 24 and do not provide the accuracy desired for subsurface compaction measurements. The depth wheel 24 measurements would provide a length as follows.

$$L_{AD}=D_D-D_A$$

To correct this value to the conditions measured during the original shop calibration, this value should be corrected to the original shop conditions of 68 degrees F., atmospheric pressure, and calibration marks at zero offset using appropriate correction factors "C" for each variable.

$$L_{shop}=L_{AD}-C_{Temp}+C_{Pressure}+C_{Calibration\ Mark}$$

The actual distance between markers 20 can be accurately and precisely determined with these corrections. If more than one log pass is performed with a housing having four detectors A–D, nine measurements are made during each logging pass. The final calculated marker spacing for each pair of markers 20 is determined by weighting each of the measurements made during each logging pass based on the repeatability of the measurements.

After nine measurements for each logging pass are calculated and nonstatistical significant data is discarded, the mean marker spacing from each individual pass is computed. The final marker spacing is the mean of all passes. The standard deviation of the mean, or precision, is the standard deviation of the individual pass measurements divided by the square root of the number of passes. This computation can also be performed by weighting the measurement from each pass according to its own distribution standard deviation.

The quality of the final measurements can be assessed by comparing the observed statistical precision to that of the computed ideal distribution. The ideal distribution is based on a theoretical analysis which assumes that the only contributing errors in the marker separation is the statistical uncertainty involved in finding the peak of the subsurface marker gamma ray distribution.

The invention permits measurement corrections after disassembly, transport and reassembly of the logging tool. The invention is applicable to scintillation detectors, casing collar locaters, and other detectors capable of detecting a subsurface anomaly. The invention eliminates the need for a conventional calibration system to be located at a well site, and eliminates errors associated with such calibration. The invention substantially reduces the impact of thermal and pressure changes, and permits highly accurate measurements of formation compaction to be developed. The invention also provides a faster and more accurate peak detection process for identifying the location of subsurface markers from the detection data generated. By correlating an ideal response distribution to the data, insignificant data is removed from the signal to facilitate additional processing. The invention provides reliable data calibrated against repeatable, known standards to provide data integrity throughout the entire producing life of a reservoir. The calibration of each tool can be verified under controlled conditions, and the accuracy of the calibration bar can be verified against standards provided by NIST or other entities to provide absolute calibration verification.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus insertable into a borehole through a geologic formation to detect the location of a subsurface marker, comprising:

a first housing section;

a first detector engaged with said first housing section for generating a first signal responsive to the marker;

a second housing section for attachment to said first housing section;

a second detector engaged with said second housing section at a selected distance from said first detector for generating a second signal responsive to the marker; and a calibrator for identifying an initial attached orientation between said first and second housing sections, and for identifying deviation from said initial attached orientation following detachment and reattachment of said first and second housing sections to indicate changes in said distance between said first and second detectors.

2. An apparatus as recited in claim 1, wherein said second housing section is rotatably attachable to said first housing section.

3. An apparatus as recited in claim 1, wherein said second housing section is longitudinally attachable to said first housing section.

4. An apparatus as recited in claim 1, further comprising a connector for attaching said first housing section to said second housing section, wherein said connector cooperates with said calibrator to identify the initial attached orientation between said first and second housing sections and to identify deviations from said initial attached orientation following detachment and reattachment of said first and second housing sections.

5. An apparatus as recited in claim 1, further comprising a controller engaged with said first detector and with said second detector for receiving said first and second signals.

6. An apparatus as recited in claim 5, wherein said first detector is capable of transmitting to said controller a signal responsive to a second subsurface marker, and wherein said controller is capable of calculating the distance between said subsurface markers.

7. An apparatus as recited in claim 5, further comprising a temperature gauge engaged with said first housing for detecting the borehole temperature and for transmitting a temperature signal to said controller, and wherein said controller is capable of correcting the calculated distance between said subsurface markers to account for the difference between the borehole temperature and a selected calibration temperature.

8. An apparatus as recited in claim 5, further comprising a pressure gauge engaged with said first housing for detecting the borehole pressure and for transmitting a pressure signal to said controller, and wherein said controller is capable of correcting the calculated distance between said subsurface markers to account for the difference between the borehole pressure and a selected calibration pressure.

9. An apparatus as recited in claim 1, wherein said controller is capable of correlating said signals with a selected distribution curve to identify each signal segment representative of the marker.

10. An apparatus as recited in claim 1, wherein the subsurface marker comprises a radioactive bullet positioned in the geologic formation proximate to the borehole, and said first and second detectors include scintillation crystals responsive to the radioactive bullet.

11. An apparatus insertable into a borehole through a geologic formation for determining the distance between the surface and a subsurface marker, comprising:

an elongated member having a lower end for insertion within the borehole;

a mechanism for selectively deploying and retrieving a selected length of said elongated member within the borehole;

a housing connected to said elongated member lower end, wherein said housing comprises a first housing section and a second housing section attached to said first housing section;

a first detector engaged with said first housing section for generating a signal responsive to the marker;

a second detector engaged with said second housing section at a selected distance from said first detector for generating a signal responsive to the marker; and a calibrator for identifying an initial attached orientation between said first and second housing sections, and for identifying deviation from said initial attached orientation following detachment and reattachment of said first and second housing sections to indicate changes in said distance between said first and second detectors.

12. An apparatus as recited in claim 11, further comprising a third detector attached to said first housing section and comprising a fourth detector attached to said second housing section, wherein said third and fourth detectors generate signals responsive to said marker.

13. An apparatus as recited in claim 11, further comprising a controller engaged with said mechanism for identifying the length of said elongated member within the borehole and for calculating the distance between said surface and the subsurface marker.

14. An apparatus as recited in claim 13, wherein said first detector is capable of transmitting a signal to said controller responsive to a second subsurface marker, and wherein said controller is capable of calculating the distance between said subsurface markers.

15. An apparatus, attachable to the lower end of an elongated member for insertion into a borehole, for determining the distance between first and second subsurface markers, comprising:

a housing section attached to the lower end of the elongated member, wherein said housing encloses an interior having a first end and a second end;

a first detector within the first end of said housing interior for generating a signal responsive to a marker;

a second detector within the second end of said housing interior for generating a signal responsive to a marker;

a spacer between said first detector and said second detector;

a first flexible retainer engaged with said first detector for permitting thermal expansion of said first detector toward said spacer; and a second flexible retainer engaged with said second detector for permitting thermal expansion of said second detector toward said spacer.

16. An apparatus as recited in claim 15, further comprising a second housing section attached to said housing section, wherein said second housing section is engaged with a third detector for generating a signal responsive to a marker.

17. An apparatus as recited in claim 16, further comprising a fourth detector engaged with said second housing section for generating a signal responsive to a marker, and further comprising a second spacer between said third and fourth detectors, a third flexible retainer for permitting thermal expansion of said third detector toward said second spacer, and a fourth flexible retainer for permitting thermal expansion of said fourth detector toward said second spacer.

18. An apparatus as recited in claim 15, further comprising a controller for receiving said signals from said first and second detectors and for calculating the distance between said first and second subsurface markers.

19. An apparatus as recited in claim 15, wherein said first and second subsurface markers are radioactive, and wherein said first and second detectors include scintillation crystals responsive to said subsurface markers.

20. A method of assembling an apparatus for insertion into a borehole through a geologic formation to detect the location of a subsurface marker, comprising the steps of:

placing a first housing section engaged with a marker sensing first detector proximate to an attachable second housing section engaged with a marker sensing second detector;

attaching said first housing section to said second housing section; and identifying the deviation of a calibrator engaged with said first and second housing sections, wherein said calibrator identifies an initial attached orientation between said first and second housing sections under selected conditions.

21. A method of calibrating a subsurface marker detection apparatus having first and second detectors and a calibrator, comprising the steps of:

placing a first housing section engaged with a marker sensing first detector proximate to an attachable second housing section engaged with a marker sensing second detector;

attaching said first housing section to said second housing section;

identifying the calibrator deviation between said first and second housing sections from an initial calibrator orientation between said first and second housing sections under selected conditions; and correcting the distance between said first and second detectors by calculating a correction factor from the deviation identified by said calibrator.

22. A method as recited in claim 21, further comprising the steps of moving at least one of said first and second detectors proximate to the subsurface marker, of generating first and second marker responsive signals correlating to each detector, and of transmitting said detector signals to a controller.

23. A method as recited in claim 22, further comprising the steps of moving at least one of said first and second detectors proximate to a second subsurface marker and of transmitting to said controller a detector signal responsive to the second subsurface marker.

24. A method as recited in claim 23, further comprising the step of operating said controller to correlate said signals with a selected distribution curve to identify each signal segment respresentative of a marker.

25. A method as recited in claim 24, further comprising the step of operating said controller to identify the peak of said selected distribution curve.

26. A method as recited in claim 22, wherein a marker sensing third detector is engaged with said first housing section, and a marker sensing fourth detector is engaged with said second housing section, further comprising the steps of moving at least one of said detectors proximate to a second subsurface marker and of transmitting to said controller at least one detector signal responsive to the second subsurface marker.

27. A method as recited in claim 26, further comprising the steps of moving said first and second housing sections so that each of said detectors generates a signal responsive to a subsurface marker, of transmitting each signal to said controller, and of operating said controller to calculate the distance between adjacent subsurface markers.

28. A method as recited in claim 27, further comprising the steps of detecting the borehole temperature with a temperature gauge, of transmitting a signal to said controller indicating the borehole temperature, and of operating said controller to adjust the calculated distance between adjacent subsurface markers.

29. A method as recited in claim 27, further comprising the steps of detecting the borehole pressure with a pressure gauge, of transmitting a signal to said controller indicating the borehole pressure, and of operating said controller to adjust the calculated distance between adjacent subsurface markers.

30. A method as recited in claim 22, further comprising the steps of detaching said housing first and second sections, of reattaching said first and second housing sections, and of identifying the deviation of a said calibrator from said initial attached orientation.

* * * * *